United States Patent [19]

King et al.

[11] 4,413,824

[45] Nov. 8, 1983

[54] REFLECTIVE GOLF BALL PUTTER ALIGNMENT DEVICE

[76] Inventors: Merlson J. King, 393 Park Ave.; John E. Wood, Jr., 135 Columbia St., both of Corning, N.Y. 14830

[21] Appl. No.: 312,883

[22] Filed: Oct. 16, 1981

[51] Int. Cl.[3] ..... A63B 69/36

[52] U.S. Cl. ..... 273/163 R

[58] Field of Search ..... 273/163 R, 163 A, 164, 273/193 R, 193 A, 193 B, 194 R, 194 A, 194 B, 186 A, 183 D

[56] References Cited

U.S. PATENT DOCUMENTS

| | | | |
|---|---|---|---|
| D. 233,535 | 11/1974 | Karban | 273/194 A X |
| 3,170,698 | 2/1965 | Schoeffler et al. | 273/194 A X |
| 3,273,891 | 9/1966 | Grim | 273/163 R |
| 3,507,500 | 4/1970 | Scott | 273/163 R X |

FOREIGN PATENT DOCUMENTS

| | | | |
|---|---|---|---|
| 16834 | of 1906 | United Kingdom | 273/163 R |

*Primary Examiner*—George J. Marlo
*Attorney, Agent, or Firm*—Harvey B. Jacobson

[57] ABSTRACT

A putter alignment device by which a golfer may develop and improve putting skills so that such skills may be utilized when golfing. The putter alignment device includes a reflective surface accurately positioned in relation to and mounted on a golf putter head with the reflective surface being oriented in a specific angular relation to the putter head and provided with horizontal and vertical lines thereon to enable a golfer to utilize a maximum length visual sighting line between the lines on the reflective surface and the golf ball. The alignment device includes a mounting device attached to the putter head, a bracket affixed to the mounting device and a reflective mirror attached to the bracket and secured in a slot-like structure by a cam device which also enables an adjustment range of approximately 6° of the reflective mirror inclination to compensate for various loft angles found on various commercially available putters.

7 Claims, 3 Drawing Figures

REFLECTIVE GOLF BALL PUTTER ALIGNMENT DEVICE

BACKGROUND OF THE INVENTION

1. Field of the Invention

The present invention generally relates to an attachment for golf clubs and more particularly an alignment device mounted in accurate relationship to a golf ball putter head with the alignment device including a reflective mirror having a horizontal and vertical indicating line thereon oriented in precise relationship to the physical characteristics of the putter head to enable a golfer to assume a proper putting stance in order to improve the putting skills.

2. Description of the Prior Art

The concept of providing a mirror attachment to putters in order to provide a sight line from the eyes of a golfer to the mirror surface, the golf ball and the desired path of movement of the golf ball is generally well known in the prior patents listed below:

U.S. Pat. Nos. 1,556,062—Oct. 6, 1925; 2,463,798—Mar. 8, 1949; 3,273,891—Sept. 20, 1966; 3,507,500—Apr. 21, 1970.

U.S. Pat. Nos. Des. 198,459—June 16, 1964; Des. 245,438—Aug. 16, 1977; Des. 245,439—Aug. 16, 1977.

SUMMARY OF THE INVENTION

An object of the invention is to provide a putter alignment device in the form of a reflective mirror attached to a golf putter head in a precise relationship to the face of the putter head to provide a vertical sight line from the golfer's eyes to a vertical sight line on the reflective mirror surface which combined with a horizontal sight line thereon will provide a precise sighting line for the golf ball to be struck by the face of the putter head for more accurate putting.

Another object of the invention is to provide a putter alignment device in accordance with the preceding object and which includes a bracket mounting structure attached to the rear of a putter head by adhesive or the like, with the alignment device also including a bracket interlockingly engaged with the mounting device and supporting the reflective mirror thereon.

A further object of the invention is to provide a putter alignment device in accordance with the preceding objects in which the bracket includes a slot-like structure receiving the reflective mirror and a cam structure securing the mirror in position and providing angular adjustment of the mirror to compensate for different loft angles on commercially available putter heads.

Yet another object of the invention is to provide a putter alignment device which offers optimum accuracy of visual alignment by means of full rearward placement of the mirror relative to the putter head face.

Another significant object of the invention is to provide an attachment to a golf putter to enable a golfer to improve his putting skills which is relatively inexpensive to manufacture, easy to accurately assemble and effective for improving putting skills.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
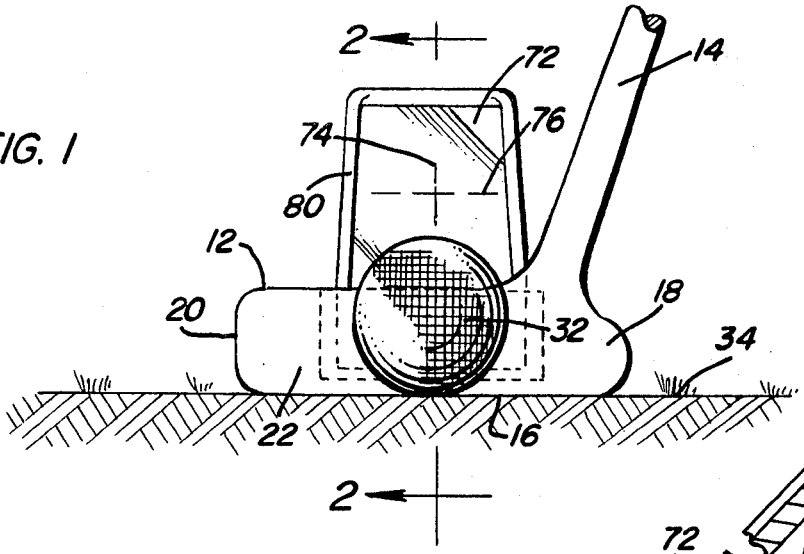
FIG. 1 is a front elevational view of a golf putter head, a golf ball and the putter alignment device mounted on the putter head.

Referring now specifically to the drawings, the alignment device of the present invention is generally designated by the numeral 10 and is attached to a conventional golf ball putter which includes the usual putter head 12 provided with a shaft 14 oriented in a conventional manner with the putter head 12 including the usual sole 16, heel 18, toe 20, striking face or surface 22 and a rear surface 24, with the striking surface 22 having a predetermined loft angle which may vary in various conventional putters. The golf putter is not altered or modified in its structure and the alignment device 10 of the present invention may be utilized with various commercially available golf ball putters. The alignment device 10 includes a bracket mount 26, a bracket 28 attached to the bracket mount 26 and a mirror 30 attached to the bracket 28, with the mirror extending rearwardly and upwardly in an inclined manner in relation to the rear surface 24 of the putter head 12 with all of the components of the alignment device 10 being disposed rearwardly of the rear surface 24 and above the sole 26, so that it will not interfere with normal swinging movement of the putter head as it engages a golf ball 32 which is resting on the grass surface or turf 34.

Figure 2:
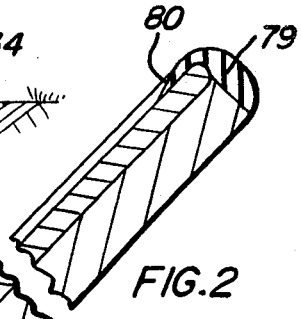
FIG. 2 is a vertical sectional view, on an enlarged scale, taken substantially along a plane passing along section line 2—2 of FIG. 1, illustrating the structural details of the putter alignment device and its association with the putter head.
Figure 3:
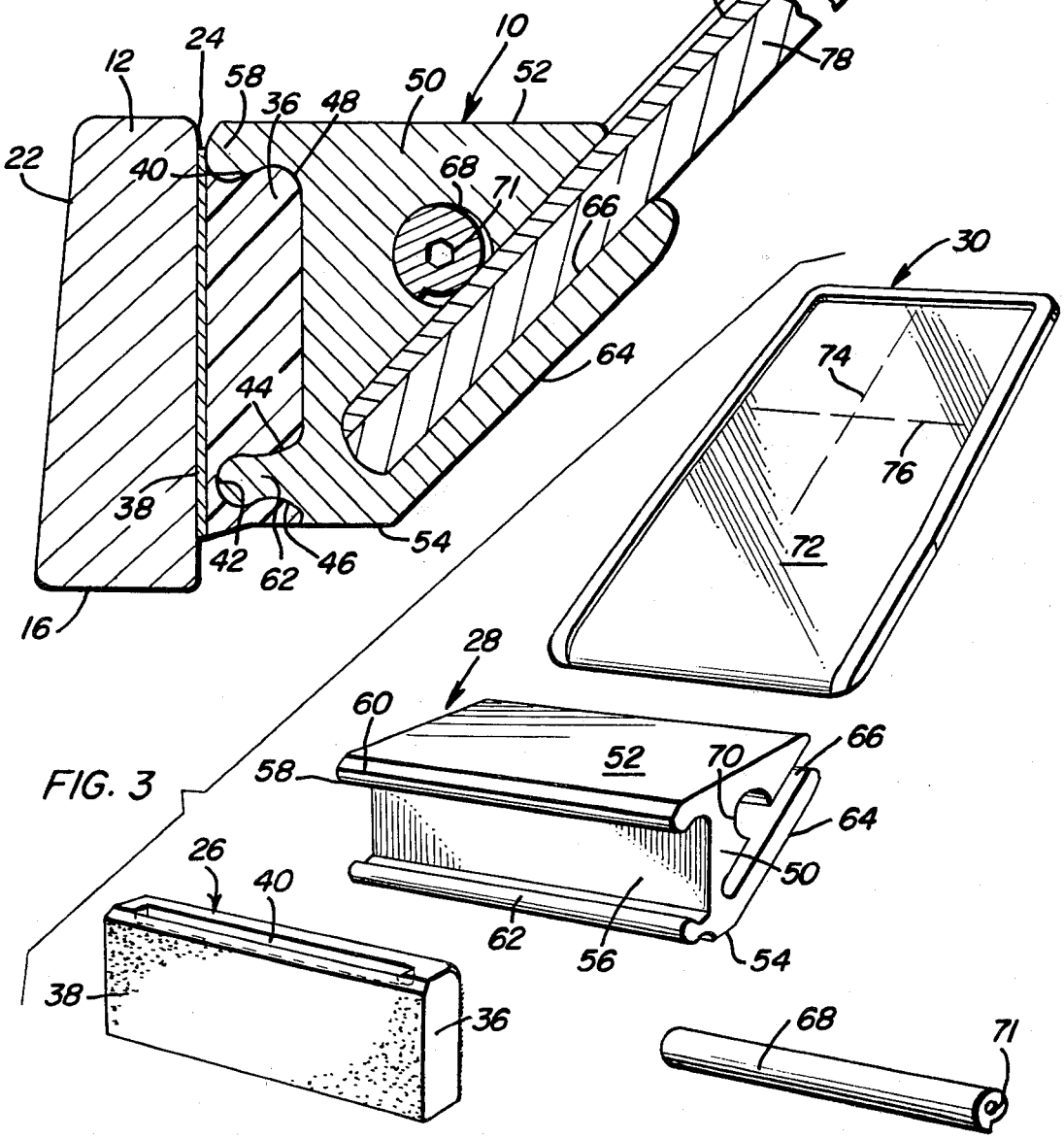
FIG. 3 is an exploded group perspective view of the four components of the putter alignment device.

The bracket mount 26 includes a longitudinally elongated body of plastic material 36 having generally parallel end edges which are of rectangular configuration and having a length less than the total length of the rear surface 24, but substantially over one-half of the length of the rear surface 24, and having a height less than the height of the rear surface 24, but substantially greater than one-half the height of the rear surface 24, as illustrated in FIG. 2. The flat front surface of the body 36 is provided with a strip of double faced adhesive 38 which fixedly secures the bracket mount 26 to the rear surface 24. Other equivalent types of adhesive attachment means may be utilized to secure the body 36 to the rear surface 24 of the putter head 12 so that the alignment device may be easily but accurately positioned on and secured to the putter head. The top surface of the body 36 is provided with a longitudinally extending groove 40 which terminates in closely spaced relation to the end edges of the body, as illustrated in FIG. 3, with the groove 40 being generally partially cylindrical in configuration, as illustrated in FIG. 2. The rear surface of the body 36 is provided with a longitudinally extending groove 42 adjacent the bottom edge thereof but spaced slightly upwardly therefrom with the groove 42 being generally U-shaped in configuration with the U-shaped groove opening rearwardly and provided with a generally partially cylindrical inner surface and the top and bottom surfaces of the groove 42 are curved as at 44 and 46 to provide a diverging or flaring entranceway to the groove 42 with the central portions of the top and bottom surfaces of the groove being slightly closer together than the inner surfaces and closer together than the outwardly flaring surfaces 44 and 46. Also, the upper corner at the rear of the body 36 is arcuately curved as at 48, as illustrated in FIG. 2.

The bracket 28 includes a body 50 of aluminum or other lightweight material which is snap fittedly engaged with the bracket mount 26. The body 50 has a length slightly less than the length of the plastic body 36 and includes a generally flat top surface 52 and a short flat bottom surface 54 interconnected by a vertical front face 56. At the upper edge of the front face 56, a continuous projecting rib 58 is provided of a shape and configuration to fit partially into the groove 40 with the downwardly facing surface of the rib 58 being partially cylindrical, as illustrated in FIG. 2 and the upper forward corner of the rib 58 being beveled or slanted as at 60. Along the bottom edge of the front face 56 of the body 50, a projecting rib 62 is provided which is continuous and projects laterally from the surface 56 slightly above the bottom edge thereof with the outer edge portion of the rib 62 being generally cylindrical in configuration, as illustrated in FIG. 2, for snap fitting engagement with the groove 42. Thus, the body 50 may be attached to the bracket mount 26 by inserting the rib 62 into the groove 42 in a snap fitting engagement and then pivoting the body 50 upwardly and snapping the rib 58 into the groove 40 so that the bracket 28 will be associated with the bracket mount 26 in the manner illustrated in FIG. 2.

The rear portion of the bracket body 50 includes an upwardly inclined bottom surface 64 forming a continuation of the short bottom surface 54 and a longitudinally continuous groove or slot 66 is formed in the body in parallel relation to the inclined surface 64 with the groove 66 extending from a point closely adjacent, but slightly spaced rearwardly of the front face 56, to the area of juncture between the top wall 52 and the inclined bottom wall 64, as illustrated in FIG. 2. The groove 66 receives the mirror 30 and extends throughout the length of the body 50 and serves as a receiving channel for receiving a substantial length of the mirror 30, so that the mirror will be supported in a stable manner. To secure the mirror 30 in the groove 66 and to adjust the mirror angularly in a limited manner, the body 50 is provided with a rotatable cam 68 mounted in a recess or substantially cylindrical channel 70 in the top wall of the groove 66 with the peripheral surface of the cam 68 engaging the upper surface of the mirror. The cam 68 includes a recess in each end or a through passageway of polygonal configuration designated by numeral 71 to receive an Allen wrench or the like in order to rotate the cam to clamp or release the mirror or adjust the angular position of the mirror to compensate for variation in loft angles of the striking face 22. The cam receiving recess or channel 70 extends around more than 180° of the cam 68 to retain it in position in the channel. It is pointed out that while an Allen wrench and recess are described for turning the cam 68, other tools and corresponding recesses, grooves, slots, and the like, may be provided on tha cam in order to enable it to be rotated.

The mirror 30 includes a reflective surface 72 of conventional mirror construction of glass or other material provided with a longitudinal or vertical indicating line 74 thereon and a transverse or horizontal indicating line 76 thereon which intersect in the central portion of the reflective surface 72 as illustrated. The mirror 30 also includes a backing plate 78 of plastic material, or the like, and the side and top edges of the reflective surface 72 and the backing plate 78 are protected and joined together by a peripheral edging member 79 which may be a separate piece from the plastic backing plate 78 or an extension thereof with a tapering lip 80 overlying a portion of the peripheral edge of the reflective surface 72, as illustrated in FIG. 2. This structure may vary depending upon the structure of the mirror and the mirror may be tapered or beveled, as illustrated in FIG. 1 or may be completely rectangular or any other desired shape.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A golf ball putter alignment device comprising a reflective surface, means mounting the reflective surface from the rear face of a golf club putter head with the reflective surface extending upwardly and rearwardly therefrom in an inclined manner, said means comprising a bracket mount attached to the rear face of the putter head, a bracket attached to the bracket mount, said reflective surface being in the form of a mirror attached to the rear portion of the bracket thereby spacing the reflective surface from the rear surface of the putter head to increase the distance between the reflective surface and a golf ball positioned in front of the striking face of the putter head for the purpose of optimizing the accuracy and sight perspective of the putter alignment device, said bracket mount including a body having a pair of groove means formed thereon, said bracket including a body having a pair of rib means formed thereon for interlocking detachable, non-adjustable engagement with the groove means to enable assembly and disassembly of the bracket mount and bracket according to a fixed relationship wherein the vertical center lines of the bracket and mount are parallel.

2. The structure as defined in claim 1 wherein said bracket mount body includes a forwardly facing substantially flat surface covering a major portion of the rear surface of the golf club putter head and secured thereto in surface to surface, stable engagement, said bracket body being engaged with the bracket mount body over widely spaced surface areas thereof to stably maintain the bracket on the bracket mount with the interlocking means interconnecting the bracket and bracket mount at widely spaced linear surface areas for maintaining the bracket and bracket mount in fixed orientation when the bracket is interlocked with the bracket mount.

3. A golf ball putter alignment device comprising a reflective surface, means mounting the reflective surface from the rear face of a golf club putter head with the reflective surface extending upwardly and rearwardly therefrom in an inclined manner, said means comprising a bracket mount attached to the rear face of the putter head, a bracket attached to the bracket mount, said reflective surface being in the form of a mirror attached to the rear portion of the bracket thereby spacing the reflective surface from the rear surface of the putter head to increase the distance between the reflective surface and a golf ball positioned in front of the striking face of the putter head for the purpose of optimizing the accuracy and sight perspective of the putter alignment device, said bracket including an upwardly and rearwardly inclined slot structure in the rear portion thereof that is capable of slidably receiving the lower end of the mirror and of opening by angular deflection of a rearward member, and means associated with the slot structure to clampingly engage the mirror and to vary the angular position thereof in relation to a single axis of rotation only, said axis being parallel with the baseline of the slot structure and perpendicular to the vertical center line of the bracket.

4. The structure as defined in claim 3 wherein said means to clamp the mirror and to vary the angular position thereof includes a rotatable linear cam mounted on the bracket and having a peripheral surface engaging the mirror for clamping the mirror in position and capable of deflecting the rearward member of the slot structure of the bracket, by displacement of the mirror against said rear member.

5. A golf ball putter alignment device comprising a reflective surface, means mounting the reflective surface from the rear face of a golf club putter head with the reflective surface extending upwardly upwardly and rearwardly therefrom in an inclined manner, said means comprising a bracket mount attached to the rear face of the putter head, a bracket attached to the bracket mount, said reflective surface being in the form of a mirror attached to the rear portion of the bracket thereby spacing the reflective surface from the rear surface of the putter head to increase the distance between the reflective surface and a golf ball positioned in front of the striking face of the putter head for the purpose of optimizing the accuracy and sight perspective of the putter alignment device, said bracket including an upwardly and rearwardly inclined slot having a bottom edge and positioned adjacent the rear of the bracket with the rear wall of the slot being defined by a deflectable wall member, said slot extending substantially throughout the length of the bracket to receive a substantial portion of the mirror with the thickness of the mirror being only slightly less than the width of the slot, a cam rotatably mounted on the bracket in generally parallel relation to the bottom of the slot and including a linear peripheral surface projectable into the slot for clamping engagement with the mirror and deflecting the rear member defining the slot.

6. The structure as defined in claim 5 wherein said cam is received in a channel in the bracket in communication with the front wall of the slot and located between the bottom and top of the slot for clampingly engaging the reflective surface of the mirror, said cam having one end thereof accessible from the end of the bracket to enable engagement of a tool therewith for rotating the cam between mirror locking and unlocking positions.

7. The structure as defined in claim 6 wherein said mirror includes a backing member and a frame structure with the reflective surface having indicia means thereon to enable a golfer to properly position the golf club and himself in relation to a golf ball.

* * * * *